US007607948B1

(12) United States Patent
Lee

(10) Patent No.: US 7,607,948 B1
(45) Date of Patent: Oct. 27, 2009

(54) CHOKE SIGNAL-ADJUSTING DEVICE

(75) Inventor: Leo Lee, Pingzhen (TW)

(73) Assignees: Elka International Ltd. (TW); Litek Technologies Co., Ltd., (TW)

( * ) Notice: Subject to any disclaimer, the term of this patent is extended or adjusted under 35 U.S.C. 154(b) by 0 days.

(21) Appl. No.: 12/252,425

(22) Filed: Oct. 16, 2008

(51) Int. Cl.
*H01R 13/66* (2006.01)

(52) U.S. Cl. ..... 439/620.22

(58) Field of Classification Search ..... 439/620.22, 439/76.1

See application file for complete search history.

(56) References Cited

U.S. PATENT DOCUMENTS 3,659,293 A * 4/1972 Gulpa ..... 342/129
3,750,165 A * 7/1973 Bailey et al. ..... 342/28
4,271,411 A * 6/1981 Takashi ..... 342/175
7,527,527 B2 * 5/2009 Morlion et al. ..... 439/620.22
7,540,780 B2 * 6/2009 Akino ..... 439/620.14
7,548,434 B2 * 6/2009 Busse et al. ..... 361/827

* cited by examiner

*Primary Examiner*—Jean F Duverne
(74) *Attorney, Agent, or Firm*—Connolly Bove Lodge & Hutz

(57) ABSTRACT

A choke signal-adjusting device, and more particularly, a signal-adjusting device capable of increasing the high-frequency signal transmission quality, comprises a circuit board disposed in a connector, a plurality of transmission circuits being disposed on the circuit board, one side of the transmission circuit being taken as a signal input terminal, and another thereof being taken as an input terminal; it is characterized in that: a plurality of chokes are correspondingly disposed in series in the middle of the plurality of transmission circuits; whereby, the balance transmission signals of unequal time duration to signals of equal time duration so as to increase the signal transmission quality effectively.

7 Claims, 8 Drawing Sheets

CHOKE SIGNAL-ADJUSTING DEVICE

BACKGROUND OF THE INVENTION

1. Field of the Invention

The present invention relates to a choke signal-adjusting device, the structure design thereof is compact and practical, capable of adjusting balance transmission signals of unequal time duration into signals of equal time duration so as to increase the transmission quality.

2. Description of Related Art

The use range of a connector is very large; it is an important bridge for connecting circuits and signals, and an important element for maintaining the normal and stable function of an electronic product. Accompanying the continuous development of electronic products toward lightness, thinness, shortness and smallness, the process capability of an internal system becomes stronger. Recently, structures of new systems such as DVD, HDTV, videophone, video conference, and the like have mostly adopted a complete digitization method to process voice and image information in order to offer users with better quality. The speed of the digital signals transmitted by them is accelerated continuously (the signals may be not compressed). Relatively, it causes the planning and design of the connector to be developed toward "fine interval spacing" and "high frequency".

However, the high-speed transmission will yield matching impedance, crosstalk, transmission delay, signal attenuation, electromagnetic interference, and the like; they cause the image signals or the voice signals easily to yield noise or disconnection while being played; the result is that the listening and viewing quality is reduced substantially. Further, the important data is easy to be lost during the network communication. These problems must be solved effectively so that the quality of the connector can be increased to match the market requirement.

The circuit board disposed in the internal part of a conventional cable connector only has a general simply-planned transmission circuit as shown in FIG. 1. There is no predisposed good signal-adjusting device therein such that the unequal time duration shown in the test result as FIG. 2 shows easily happens between two adjacent pins when it is used on high-frequency balance transmission to influence the signal transmission effect seriously; this is the main deficit.

SUMMARY OF THE INVENTION

For improving the conventional connector structure, the present invention proposes a choke signal-adjusting device; the structure design thereof is compact and practical, capable of adjusting balance transmission signals of unequal time duration into signals of equal time duration so as to increase the transmission quality.

For achieving the object mentioned above, the present invention proposes a choke signal-adjusting device, and more particularly, a signal-adjusting device capable of increasing the high-frequency signal transmission quality, comprises a circuit board disposed in a connector, a plurality of transmission circuits being disposed on the circuit board, one side of the transmission circuit being taken as a signal input terminal, and another thereof being taken as an input terminal; it is characterized in that: a plurality of chokes are correspondingly disposed in series in the middle of the plurality of transmission circuits; whereby, the balance transmission signals of unequal time duration to signals of equal time duration so as to increase the signal transmission quality effectively.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
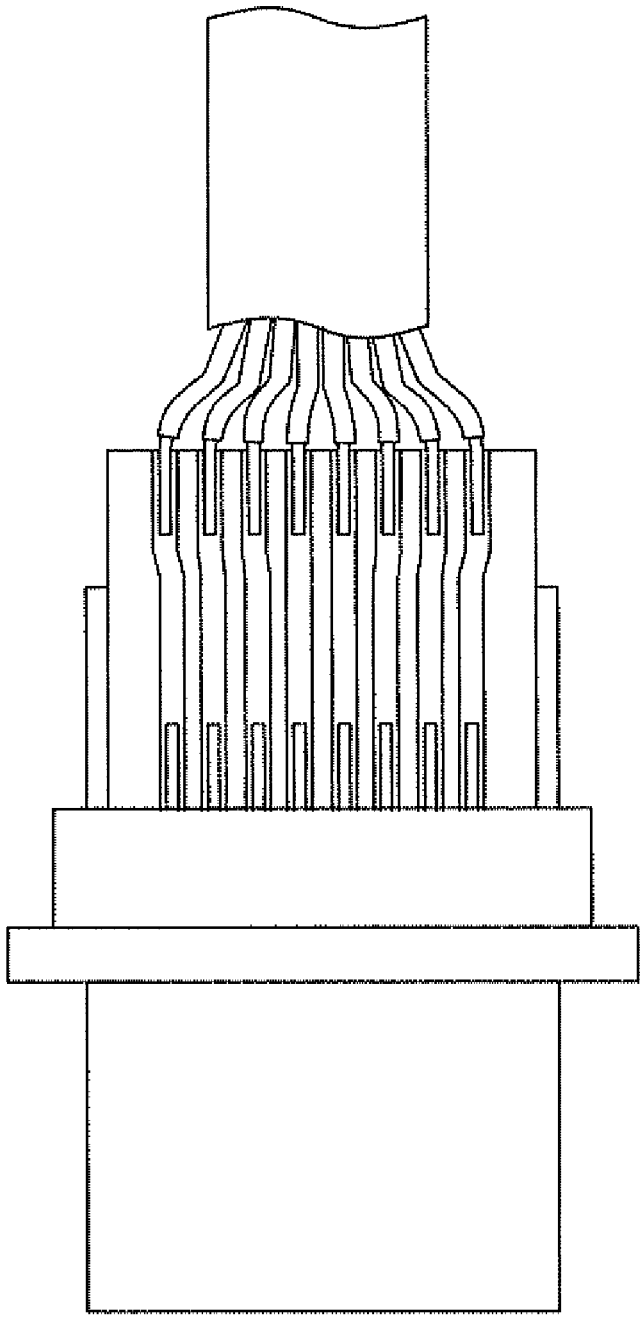
FIG. 1 is a plane view of a conventional connector structure.
Figure 2:
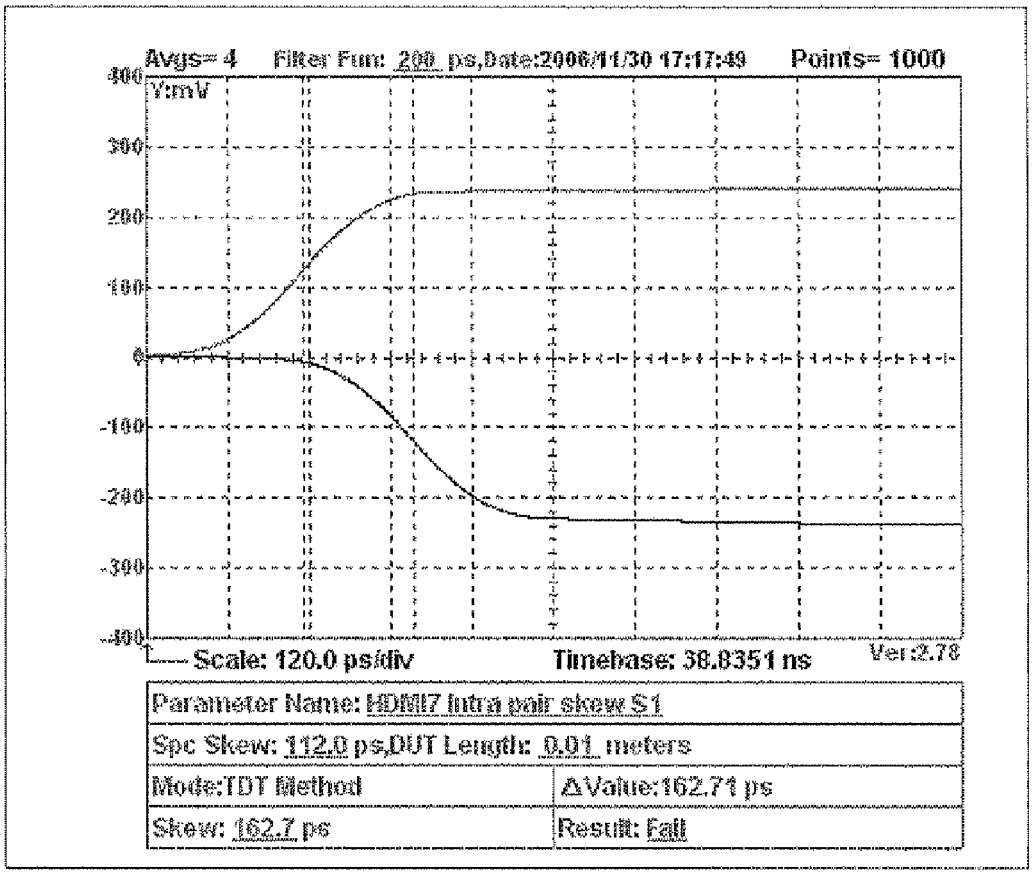
FIG. 2 is a graph of a signal test of the conventional structure.
Figure 3:
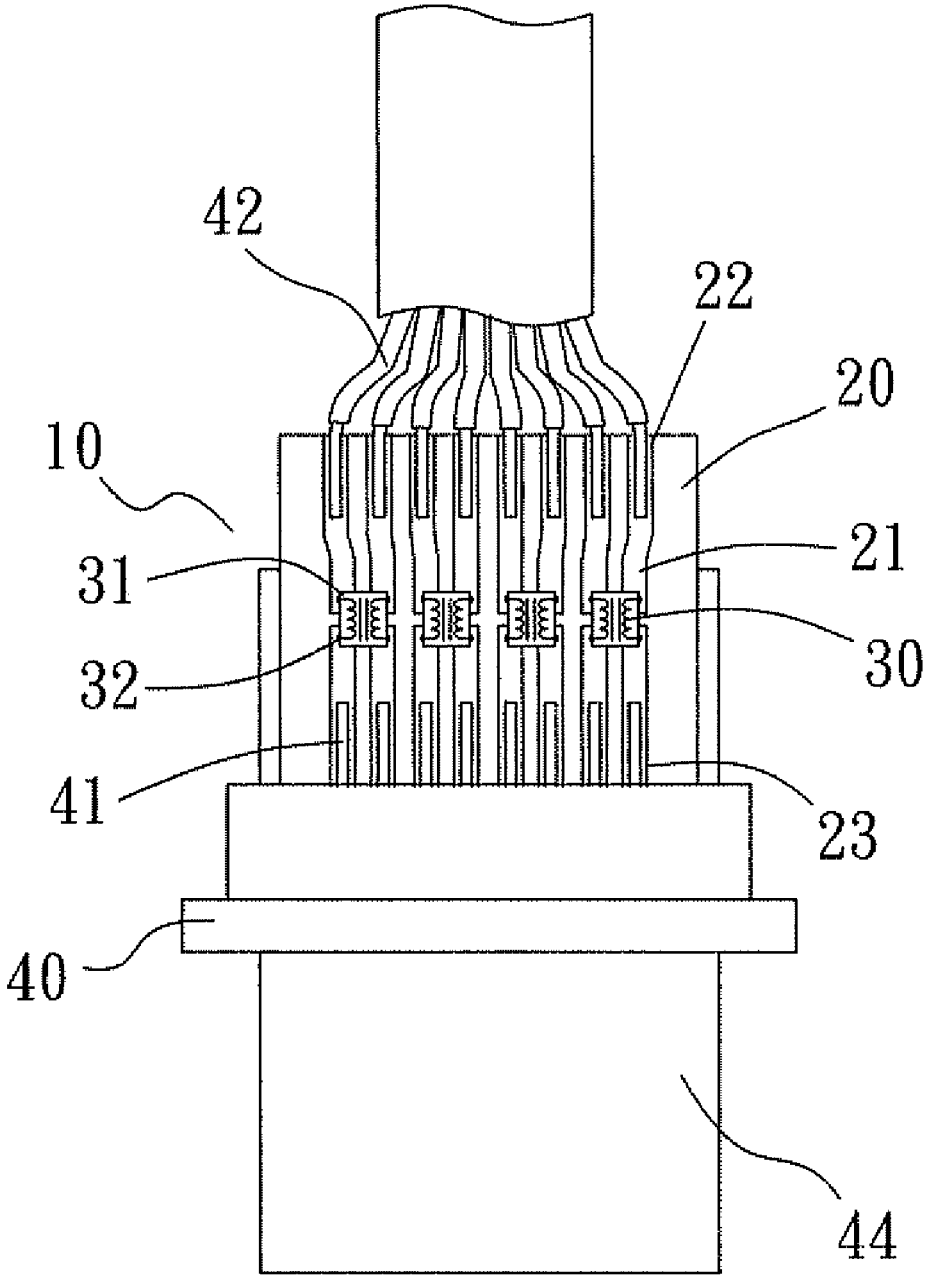
FIG. 3 is a plane view of a choke signal-adjusting device according to the present invention.
Figure 4:
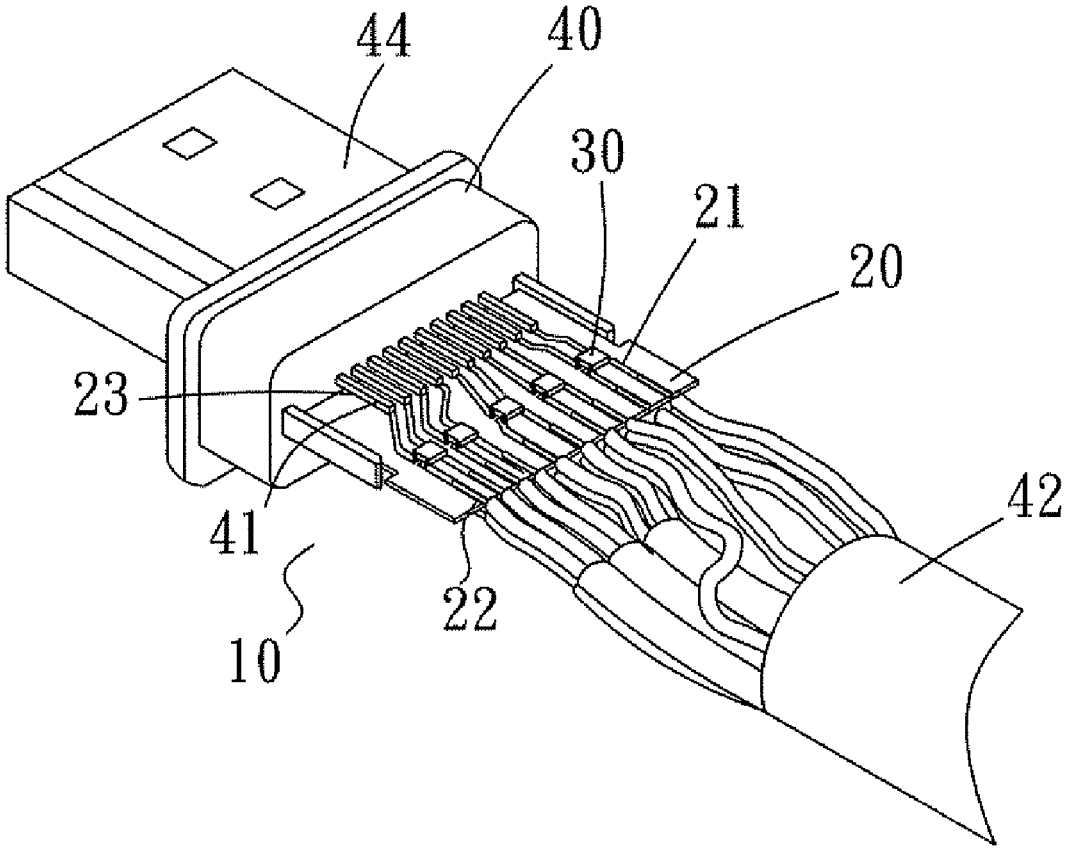
FIG. 4 is a perspective view of a choke signal-adjusting device according to the present invention.

Please refer to FIGS. 3 to 9. A choke signal-adjusting device 10 according to the present invention includes a circuit board 20, and a plurality of transmission circuits 21 are disposed on the circuit board 20, where one side of the transmission circuits 21 is taken as a signal input terminal 22 and another side thereof is taken as a signal output terminal 23; it is characterized in that a plurality of chokes 30 are correspondingly disposed in series in the middle of the plurality of transmission circuits 21. The plurality of chokes 30 may be made from common chokes while being put into practice as FIGS. 3 and 4 show; the common choke is made by disposing two cross-coupling chokes 30 in a housing 31 and projecting four pins 32 out of the housing 31 to allow them to be respectively crossed over a preserved position of the two adjacent transmission circuits 21.

Figure 5:
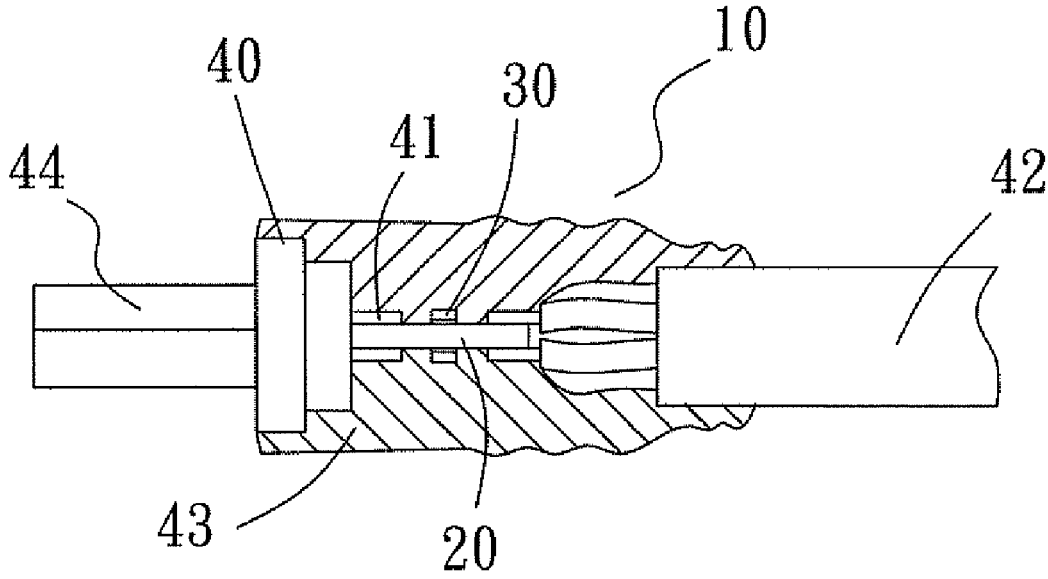
FIG. 5 is a cross sectional view of a cable connector made from a choke signal-adjusting device according to the present invention.

Please refer to FIGS. 3, 4 and 5. The choke signal-adjusting device 10 may be assembled onto a cable connector 40 directly while being manufactured, and a circuit board 20 is buried into the cable connector 40 to allow an output terminal 23 of the transmission circuit 21 to be electrically connected to an output terminal 41 of the connector 40 and an input terminal 22 at another side of the transmission circuit 21 to be electrically connected to a cable 42. The circuit board 20 is positioned inside the cable connector 40, and an outer cover 43 made from a plastic material is disposed outside the cable connector 40. Further, at least one output terminal 44 is disposed on one end of the outer cover 43.

Figure 6:
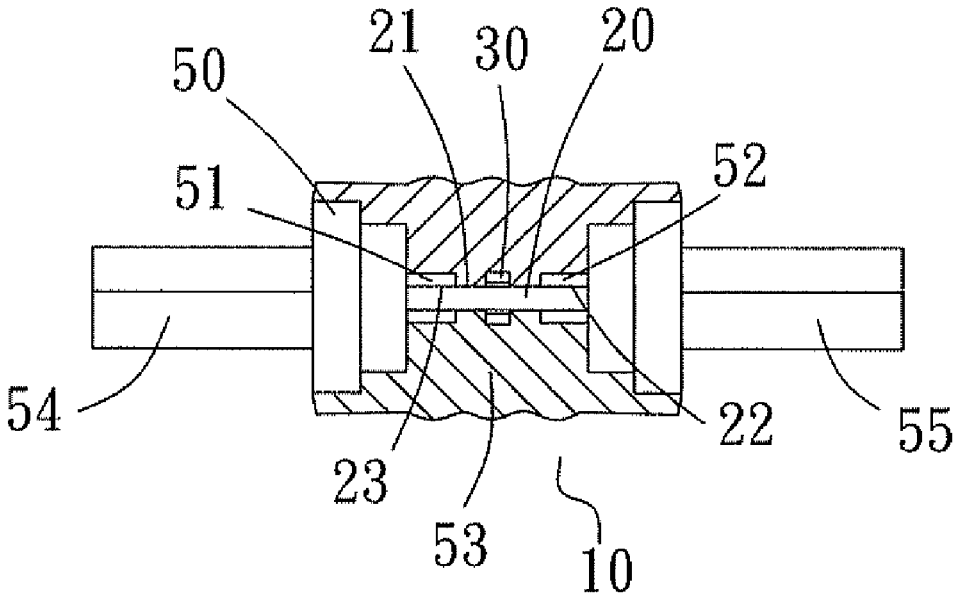
FIG. 6 is a cross sectional view of a connector adapter made from a choke signal-adjusting device according to the present invention.
Figure 7:
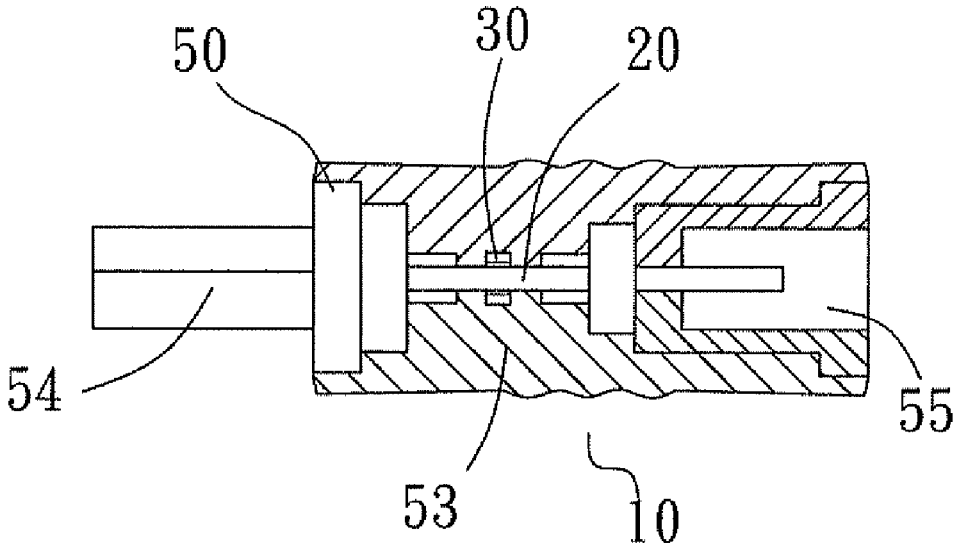
FIG. 7 is a cross sectional view of another connector adapter made from a choke signal-adjusting device according to the present invention.
Figure 8:
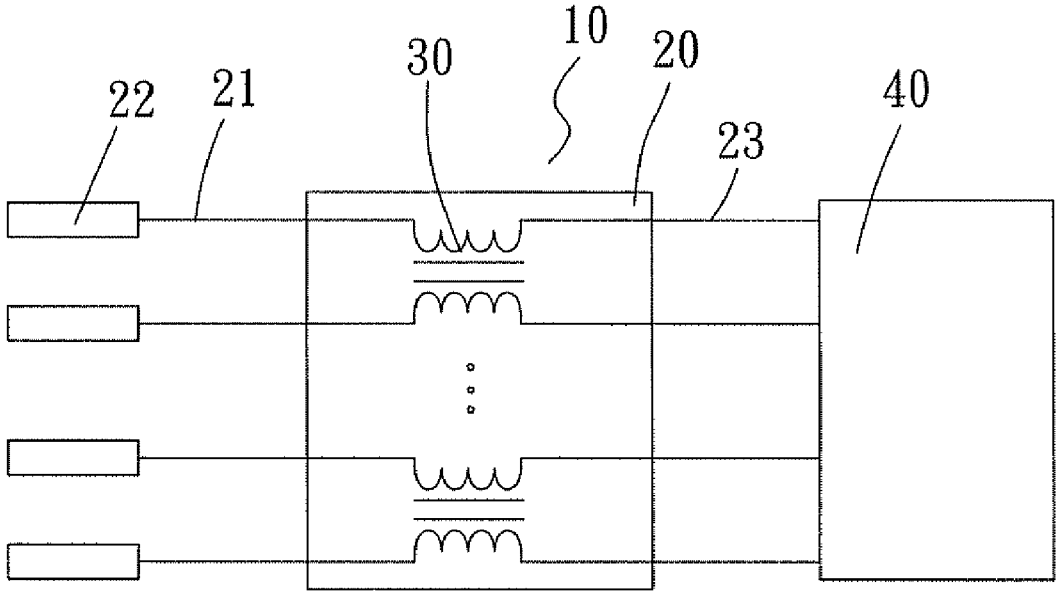
FIG. 8 is a circuit diagram of a choke signal-adjusting device according to the present invention.
Figure 9:
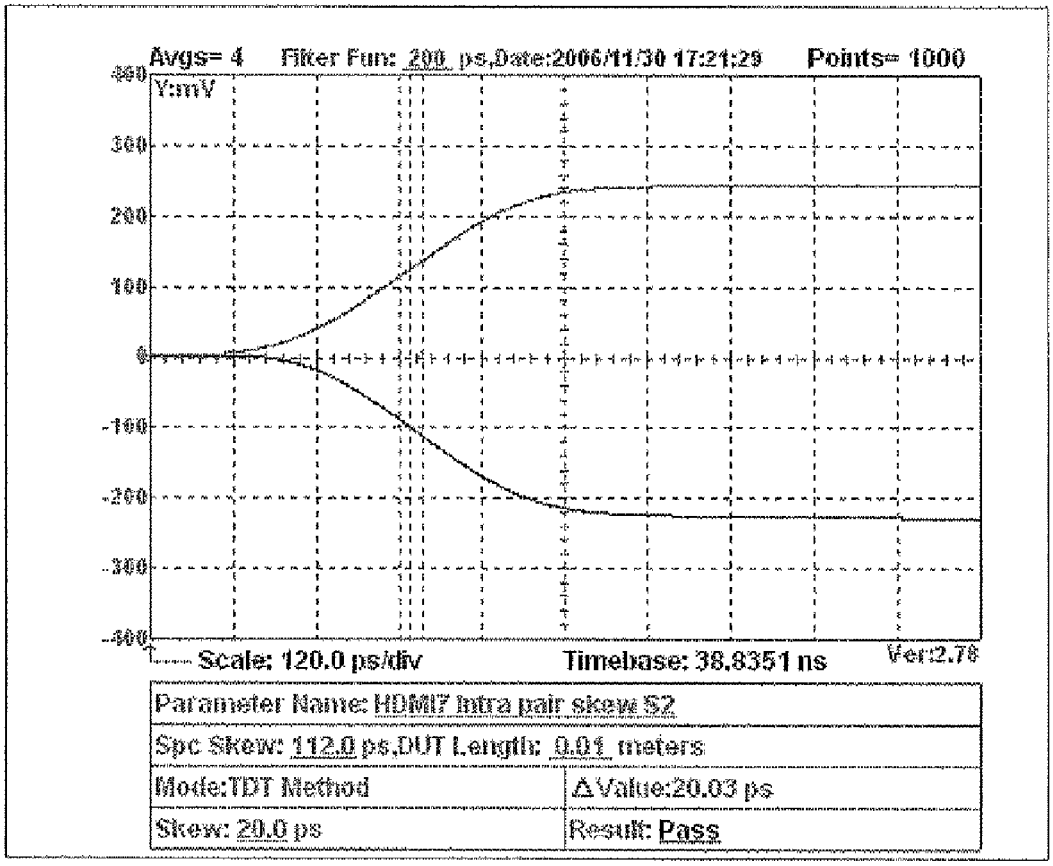
FIG. 9 is a graph of a signal test of a choke signal-adjusting device according to the present invention.

Furthermore, the choke signal-adjusting device 10, as FIGS. 6 and 7 show, may also be disposed on a connector adapter 50, and the circuit board 20 is buried into the connector adapter 50 to allow the output terminal 23 of the transmission circuit 21 to be electrically connected to an output terminal 51 of the connector adapter 50, and the input terminal 22 of the transmission circuit 21 to be electrically connected to an input terminal 52 of the connector adapter 50.

While being assembled, the connector adapter 50 includes the aforementioned inbuilt circuit board 20, an outer cover 53 made from a plastic material and at least one output terminal 54 and input terminal 55.

Wherein, the output terminal 54 and the input terminal 55 at the two ends of the connector adapter 50 may be set to the same type, for example, the both are the same male type (or the same female type) shown in FIG. 6, or the both are different types (one is a male type and another one is a female type) shown in FIG. 7, thereby being convenient for a user to do selections for different types of insertion uses, and allowing a general cable connector to have the functions of the signal-adjusting device 10 of the present invention through the connector adapter 50.

Whereby, as FIGS. 3 to 8 show, while being put into practice, the output terminal 54 or 44 of the connector adapter 50 or the cable connector 40 made from the signal-adjusting device 10 of the present invention may be utilized to connect with a general display device such as liquid crystal television (not shown in the figures) or a signal duplicator such as audio/video facility (not shown in the figures). Whereby, an unequal time duration state happening in the conventional structure originally can be adjusted to an equal time duration state during a high-frequency balance signal transmission because the choke 30 is correspondingly disposed in series between each two adjacent transmission circuits 21 disposed on the inbuilt circuit board 20 of the present invention. The best signal adjustment effect shown in FIG. 9 can be obtained after a test.

Thus, it can proves that the signal-adjusting device 10 of the present invention can have a very good signal adjustment function and is capable of increasing the signal transmission quality effectively to avoid noise or disconnection generated when image signals or voice signals are played in a high-frequency transmission, or important data loss during a network communication.

Conclusively, the structure of the present invention is compact and practical and the functions thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A choke signal-adjusting device, capable of increasing the high-frequency signal transmission quality, said signal-adjusting device comprising a circuit board disposed in a connector, a plurality of transmission circuits being disposed on said circuit board, one side of said transmissions being a signal input terminal and another side thereof being a signal output terminal; wherein, a plurality of chokes are correspondingly disposed in series in the middle of said plurality of transmission circuits; whereby, balance transmission signals of unequal time duration are adjusted to signals of equal time duration to enable the signal transmission quality to be increased effectively.

2. The choke signal-adjusting device according to claim 1, wherein the plurality of chokes adopt common chokes, said common choke is constituted by disposing two cross-coupling chokes in a housing and projection four pins used for respectively crossing over a reserved position of said two adjacent transmission circuits outside said housing.

3. The choke signal-adjusting device according to claim 2, wherein said connector is a cable connector, said circuit board is buried inside said cable connector to allow an output terminal of said transmission circuit to be electrically connected to an output terminal of said connector and an input terminal on another side of said transmission circuit to be electrically connected to a cable.

4. The choke signal-adjusting device according to claim 2, wherein said connector is a connector adapter, said circuit board is buried inside said connector adapter to allow an output terminal of said transmission circuit to be electrically connected to an output terminal of said connector adapter and an input terminal on another side of said transmission circuit to be electrically connected to an input terminal of said connector adapter.

5. The choke signal-adjusting device according to claim 3, wherein said cable connector comprises said inbuilt circuit board, an outer cover made from a plastic material and at least one output terminal.

6. The choke signal-adjusting device according to claim 4, wherein two ends of said connector adapter are respectively disposed with the same type of terminal.

7. The choke signal-adjusting device according to claim 4, wherein two sides of said connector adapter are respectively disposed with different male and female terminals.

* * * * *